US006802698B2

(12) United States Patent
Tsukamoto

(10) Patent No.: US 6,802,698 B2
(45) Date of Patent: Oct. 12, 2004

(54) PORT COVER FOR PROTECTING NOT ONLY A PORT OF A COMPRESSOR BUT ALSO A PIPE FIXING PORTION THEREOF

(75) Inventor: Kou Tsukamoto, Isesaki (JP)

(73) Assignee: Sanden Corporation, Gunma (JP)

( * ) Notice: Subject to any disclaimer, the term of this patent is extended or adjusted under 35 U.S.C. 154(b) by 31 days.

(21) Appl. No.: 10/356,533

(22) Filed: Feb. 3, 2003

(65) Prior Publication Data

US 2003/0147756 A1 Aug. 7, 2003

(30) Foreign Application Priority Data

Feb. 4, 2002 (JP) ..... 2002-026207

(51) Int. Cl.[7] ..... F04B 53/00
(52) U.S. Cl. ..... 417/234; 318/89
(58) Field of Search ..... 417/234, 63; 138/89, 138/92, 89.1–89.4, 96 R, 94.5, 103, 111; 215/295, 296, 305; 220/327, 328, 242, 254, 255, 270, 318, 361, 780–794, 796–806, 23.2

(56) References Cited

U.S. PATENT DOCUMENTS 5,496,141 A * 3/1996 Popsys ..... 411/510
5,988,223 A * 11/1999 Kanzaki et al. ..... 138/89
6,053,350 A * 4/2000 Suitou et al. ..... 220/327
6,290,092 B1 * 9/2001 Cote et al. ..... 220/796

FOREIGN PATENT DOCUMENTS

| | | | | |
|---|---|---|---|---|
| JP | 60 93088 | | 6/1985 | ..... F16L/41/08 |
| JP | 07158564 A | * | 6/1995 | ..... F04B/39/12 |
| JP | 10 213071 | | 8/1998 | ..... F04B/39/12 |
| JP | 2000 291866 | | 10/2000 | ..... F16L/33/00 |

* cited by examiner

*Primary Examiner*—Justine R. Yu
*Assistant Examiner*—Han L Liu
(74) *Attorney, Agent, or Firm*—Baker Botts L.L.P.

(57) ABSTRACT

A port cover is removably attached to a compressor to protect a port of the compressor. The port cover is integrally made of elastomer and has a cap member adapted to close the port, a cover member coupled to the cap member and adapted to cover a pipe fixing portion of the compressor, and a handle extending from the cap member. The cover member has a cylindrical portion faced to a side surface of the pipe fixing portion. The cylindrical portion has a specific portion extending from a first end of the cylindrical portion opposite to the compressor towards a second end opposite to the first end. The specific portion allows the first end of the cylindrical portion to be increased in diameter.

12 Claims, 6 Drawing Sheets

PORT COVER FOR PROTECTING NOT ONLY A PORT OF A COMPRESSOR BUT ALSO A PIPE FIXING PORTION THEREOF

BACKGROUND OF THE INVENTION

This application claims priority to prior application JP 2002-026207, the disclosure of which is incorporated herein by reference.

The present invention relates to a port cover for protecting a port of a compressor for compressing a fluid.

The compressor of the type has a suction port for introducing a fluid to be compressed and a discharge port for delivering the fluid after compressed. Herein, the suction port and the discharge port may collectively and simply be called a port.

During use of the compressor, a pipe for guiding the fluid is connected to the port. On the other hand, during transportation of the compressor, no pipe is generally connected to the compressor. In view of the above, it is proposed, for example, in Japanese Unexamined Utility Model Publication No. H4-11275 (JP 4-11275 U), to provide the compressor with a port cover for protecting the port during transportation of the compressor. As a matter of fact, the port cover is removably attached to the compressor.

During use of the compressor, the pipe may be fixed and secured to a pipe fixing portion protruding on an outer surface of the compressor in order to achieve stable connection between the pipe and the port. For example, the pipe fixing portion may be a stud bolt planted on the compressor in the vicinity of the port. The stud bolt has a thread formed on its outer peripheral surface. Therefore, during transportation of the compressor, it is desired to protect not only the above-mentioned port but also the pipe fixing portion so as to prevent the thread from being damaged.

Because of the presence of the pipe fixing portion in the vicinity of the port, attachment or removal of the port cover may often be difficult or inhibited by interference with the pipe fixing portion. In order to solve the above-mentioned problem, it is desired that the port cover does not interfere with the pipe fixing portion when the port cover is attached or removed.

SUMMARY OF THE INVENTION

It is therefore an object of the present invention to provide a port cover which serves to protect not only a port of a compressor but also a pipe fixing portion and which can be easily attached or removed.

Other objects of the present invention will become clear as the description proceeds.

According to an aspect of the present invention, there is provided a port cover which is removably attached to a compressor comprising a compressor housing, a port formed on the compressor housing to be connected to a pipe, and a pipe fixing portion formed on the compressor housing in the vicinity of the port to protrude therefrom and adapted to fix and secure the pipe and which serves to protect the port when the port cover is attached to the compressor. In the port cover, the port cover is made of elastomer and integrally formed. The port cover comprises a cap member adapted to close the port, a cover member coupled to the cap member and adapted to cover the pipe fixing portion, the cover member having a cylindrical portion faced to a side surface of the pipe fixing portion, and a handle extending from the cap member. The cylindrical portion has at least one specific portion extending from a first end of the cylindrical portion opposite to the compressor housing towards a second end opposite to the first end. The at least one specific portion allows the first end of the cylindrical portion to be increased in diameter.

DESCRIPTION OF PREFERRED EMBODIMENTS

Figure 1:
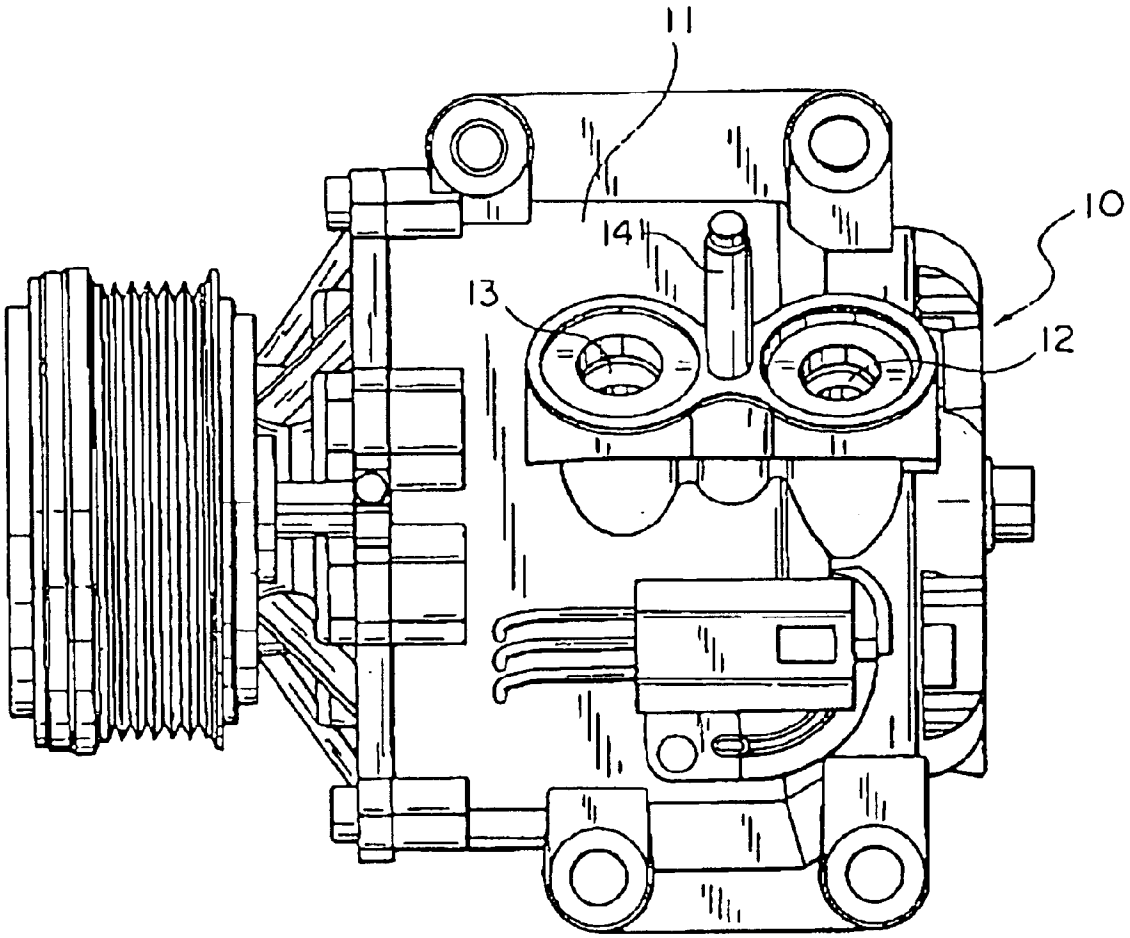
FIG. 1 is a perspective view of a compressor, as one example.

Referring to FIG. 1, a compressor as one example will be described.

The compressor depicted at 10 in FIG. 1 is for use in an air conditioner for a vehicle and comprises a compressor housing 11. The compressor housing 11 is provided with a suction port 12 and a discharge port 13 to be connected with pipes (not shown). In the vicinity of the suction port 12 and the discharge port 13, i.e., at a position between the suction port 12 and the discharge port 13, a stud bolt 14 is planted on the compressor housing 11 and protrudes therefrom. The stud bolt 14 serves to fix and secure the pipes connected to the suction port 12 and the discharge port 13 to the compressor housing 11. The stud bolt 14 has a thread formed on its outer peripheral surface. The stud bolt 14 forms a pipe fixing portion.

Figure 2A:
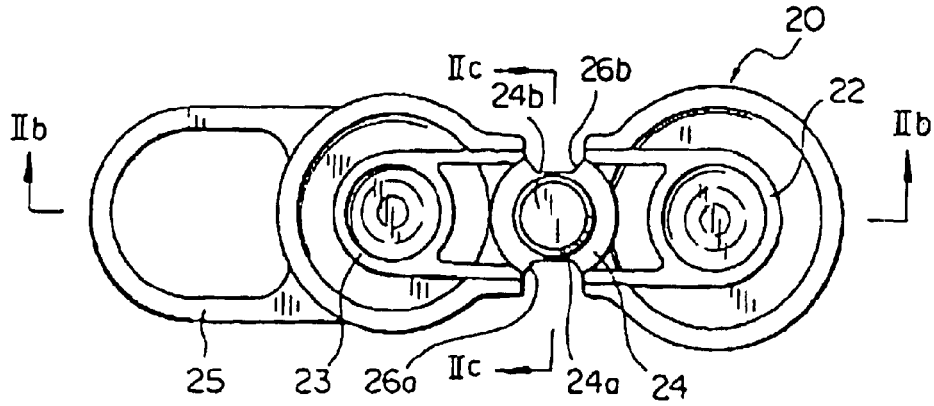
FIG. 2A is a plan view of a port cover according to a first embodiment of the present invention.
Figure 2B:
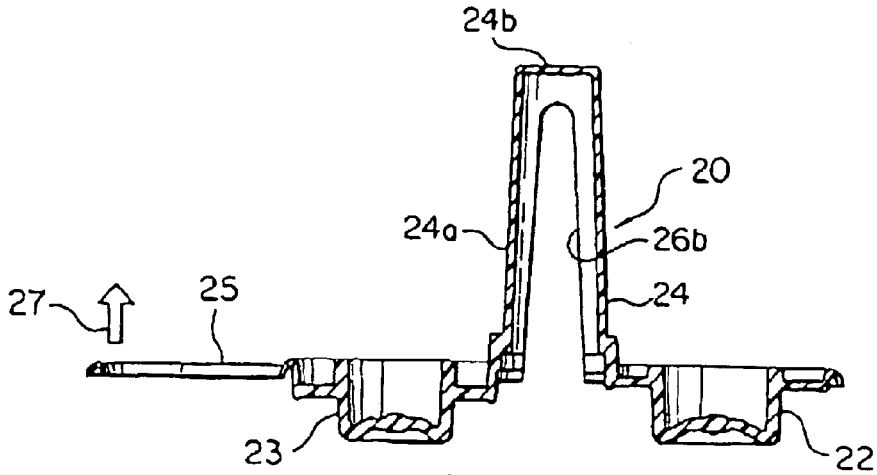
FIG. 2B is a sectional view taken along a line IIb—IIb in FIG. 2A.
Figure 2C:
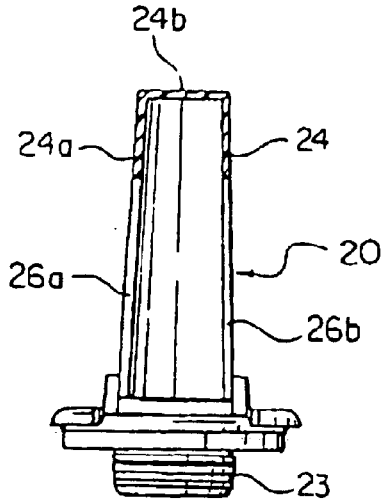
FIG. 2C is a sectional view taken along a line IIc—IIc in FIG. 2A.

Referring to FIGS. 2A to 2C in addition to FIG. 1, description will be made of a port cover according to a first embodiment of the present invention.

The port cover depicted at 20 in FIGS. 2A to 2C is mounted to the compressor housing 11 and serves to protect not only the suction port 12 and the discharge port 13 but also the stud bolt 14. The port cover 20 is made of elastomer and integrally formed to have an integral structure. The port cover 20 has a first cap portion 22 having a closed-bottom cylindrical shape and adapted to be press-fitted into the suction port 12, a second cap portion 23 having a closed-bottom cylindrical shape and adapted to be press-fitted into the discharge port 13, a close-top cylinder member 24 to serve as a cover portion for covering the stud bolt 14, and a handle 25 extending from the second cap portion 23 in a direction away from the stud bolt 14. The closed-top cylinder member 24 has a long cylindrical portion 24*a* as a side wall fitted around the stud bolt 14 with a gap left therebetween. The cylindrical portion 24*a* is faced to a side surface of the stud bolt 14 and has a first or lower end to be faced to the compressor housing 11 and a second or upper end opposite to the lower end. Furthermore, the cylindrical portion 24*a* has an end plate portion 24*b* coupled integral with the upper end of the cylindrical portion 24*a* and faced to an axial upper end of the stud bolt 14.

The cylindrical portion 24*a* has a pair of recesses or cutouts 26*a* and 26*b* faced to each other in a radial direction of the cylindrical portion 24*a*. A line connecting the recesses 26*a* and 26*b* is substantially orthogonal to a line connecting the first and the second cap portions 22 and 23. Each of the recesses 26*a* and 26*b* is recessed or extends from the lower end of the cylindrical portion 24*a* towards the upper end thereof in a longitudinal direction, thereof.

During transportation of the compressor 10, the port cover 20 is attached to the compressor housing 11. Specifically, the closed-top cylinder member 24 is put over the stud bolt 14. The first and the second cap portions 22 and 23 are press-fitted into the suction port 12 and the discharge port 13, respectively. As a consequence, the suction port 12, the discharge port 13, and the stud bolt 14 are protected by the port cover 20.

When the compressor 10 is mounted to the vehicle air conditioner, the port cover 20 is removed from the compressor housing 11. As depicted by a white arrow 27 in FIG. 2B, the handle 25 is pulled in the longitudinal direction of the closed-top cylinder member 24, i.e., pulled upward. As a consequence, the second cap portion 23 is pulled out from the discharge port 13. When the second cap portion 23 is pulled out from the discharge port 13, the recesses 26*a* and 26*b* of the closed-top cylinder member 24 are opened so that the lower end of the closed-top cylinder member 24 is substantially increased in diameter. When the handle 25 is further pulled upward, the closed-top cylinder member 24 is opened in a hinge-like fashion relative to the top wall, i.e., the end plate portion 24*b*. Then, the closed-top cylinder member 24 is separated from the stud bolt 14 without interference with the stud bolt 14. When the handle 25 is further pulled upward, the first cap portion 22 is pulled out from the suction port 12.

The above-mentioned port cover 20 can readily be removed from the compressor 10 without causing interference between the closed-top cylinder member 24 and the stud bolt 14. Furthermore, the second cap portion 23 is at first pulled out from the discharge port 13 and, thereafter, the first cap portion 22 is pulled out from the suction port 12. Accordingly, only a small force is required to remove the port cover 20. In addition, removal of the port cover 20 can be performed by a single operation of pulling the handle 25 in the direction depicted by the white arrow 27.

The handle 25 may extend from the first cap portion 22, not from the second cap portion 23. Alternatively, the handle 25 may be provided at each of the first and the second cap portions 22 and 23.

Figure 3A:
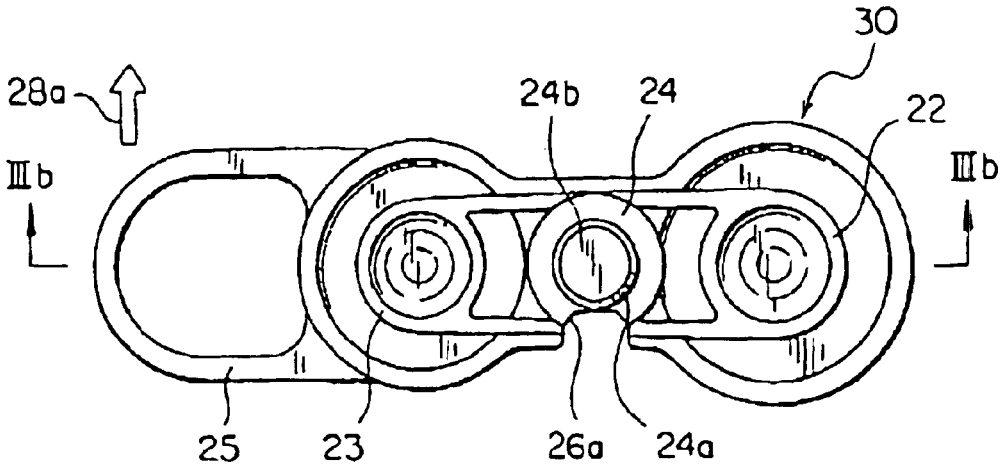
FIG. 3A is a plan view of a port cover according to a second embodiment of the present invention.
Figure 3B:
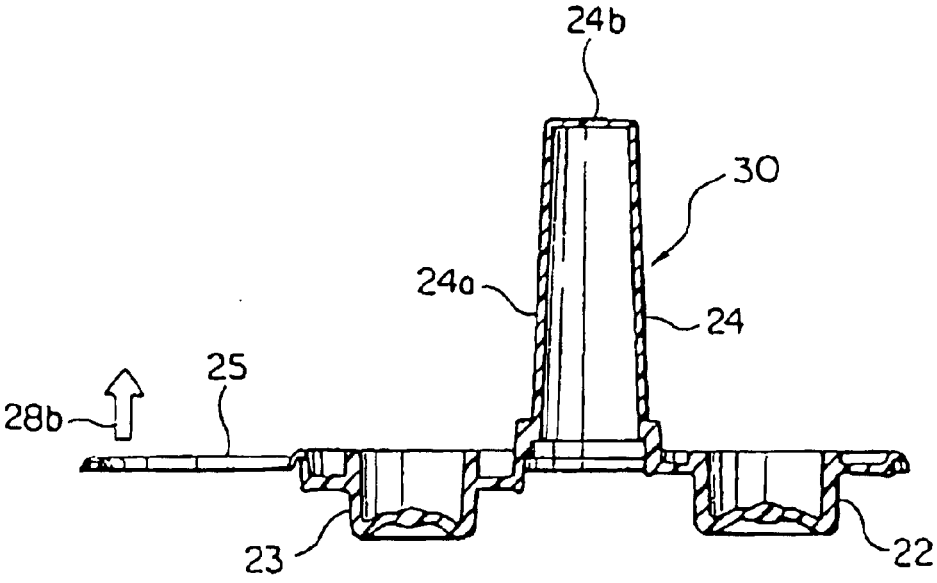
FIG. 3B is a sectional view taken along a line IIIb—IIIb in FIG. 3A.

Referring to FIGS. 3A and 3B in addition to FIG. 1, description will be made of a port cover according to a second embodiment of the present invention. Similar parts are designated by like reference numerals.

In the port cover depicted at 30 in FIGS. 3A and 3B, the side wall (i.e., the cylindrical portion 24*a*) of the closed-top cylinder member 24 is provided with the single recess 26*a* extending from the open end towards the top wall (i.e., the end plate portion 24*b*) of the closed-top cylinder member 24 in the longitudinal direction. In other words, no recess is formed in the side wall (i.e., the cylindrical portion 24*a*) of the closed-top cylinder member 24 at a position opposite to the recess 26*a* in the radial direction. The recess 26*a* has an open end oriented in a direction substantially perpendicular to the line connecting the first and the second cap portions 22 and 23.

During transportation of the compressor 10, the port cover 30 is attached to the compressor housing 11 Specifically, the closed-top cylinder member 24 is put over the stud bolt 14. The first and the second cap portions 22 and 23 are press-fitted into the suction port 12 and the discharge port 13 respectively. As a consequence, the suction port 12, the discharge port 13, and the stud bolt 14 are protected by the port cover 30.

When the compressor 10 is mounted to the vehicle air conditioner, the port cover 30 is removed from the compressor housing 11. In a direction which intersects two directions indicated by white arrows 28*a* and 28*b*, the handle 25 is pulled to increase the recess 26*a* in width. As a consequence, the second cap portion 23 is pulled out from the discharge port 13. Simultaneously when the second cap portion 23 is pulled out from the discharge port 13, the recess 26*a* is increased in width so that a portion of the side wall of the closed-top cylinder member 24 which is near a side line of the recess 26*a* is turned outside. Therefore, the closed-top cylinder member 24 is separated from the stud bolt 14 without interfering with the stud bolt 14. When the handle 25 is further pulled in the direction depicted by the white arrow 28, the first cap portion 22 is pulled out from the suction port 12.

The above-mentioned port cover 30 can readily be removed from the compressor 10 without causing interference between the closed-top cylinder member 24 and the stud bolt 14. Furthermore, the second cap portion 23 is at first pulled out from the discharge port 13 and, thereafter, the first cap portion 22 is pulled out from the suction port 12. Accordingly, only a small force is required to remove the port cover 30. In addition, removal of the port cover 30 can be performed by a single operation of pulling the handle 25 in the direction depicted by the white arrow 28.

The position of the recess 26*a* may be shifted by 180 degrees in a circumferential direction of the cylindrical portion 24*a*. The handle 25 may extend from the first cap portion 22, not from the second cap portion 23. Alternatively, the handle 25 may be provided at each of the first and the second cap portions 22 and 23.

Figure 4A:
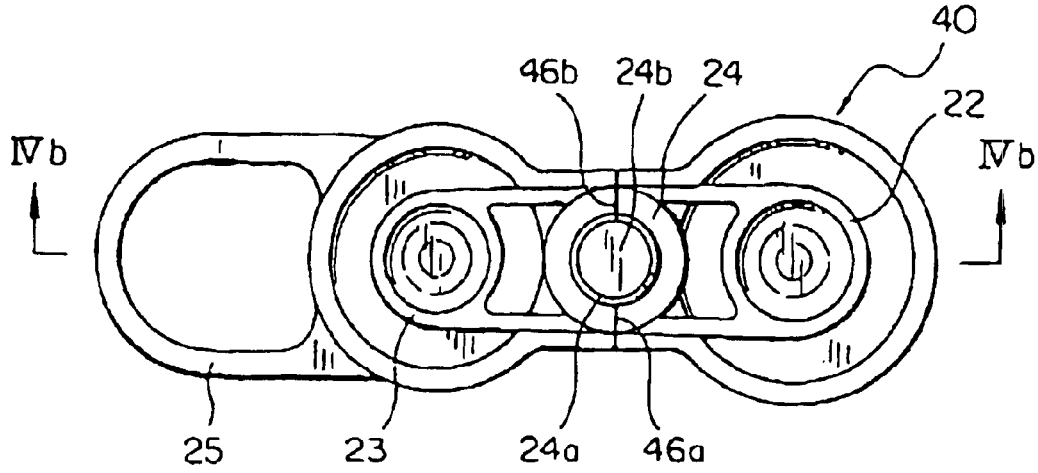
FIG. 4A is a plan view of a port cover according to a third embodiment of the present invention.
Figure 4B:
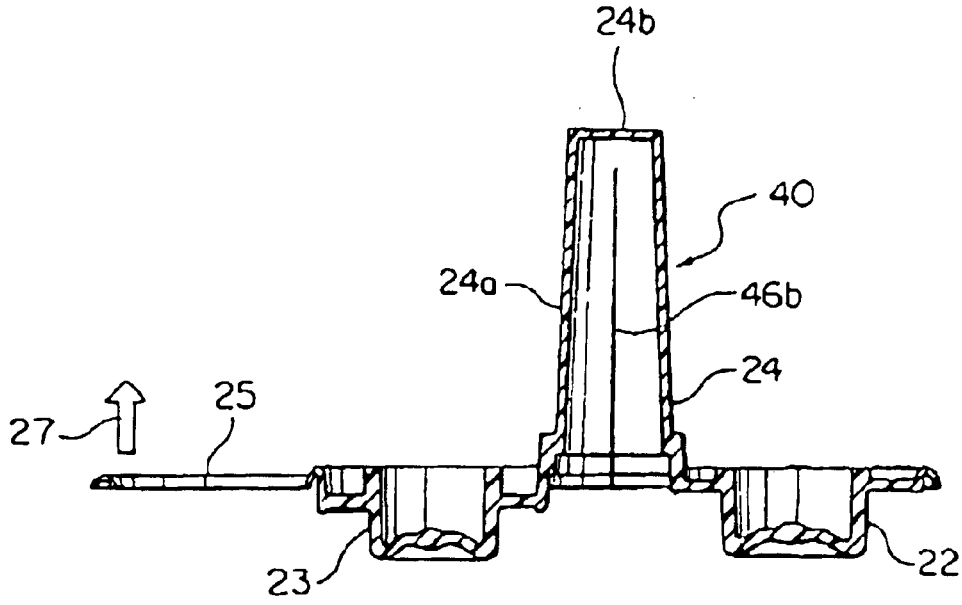
FIG. 4B is a sectional view taken along a line IVb—IVb in FIG. 4A.

Referring to FIGS. 4A and 4B in addition to FIG. 1, description will be made of a port cover according to a third embodiment of the present invention. Similar parts are designated by like reference numerals.

In the port cover depicted at 40 in FIGS. 4A and 4B, the side wall (i e., the cylindrical portion 24*a*) of the closed-top cylinder member 24 is provided with a pair of slits 46*a* and 46*b* extending from the open end towards the top wall (i.e., the cylindrical portion 24*a*) of the closed-top cylinder member 24 in the longitudinal direction and faced to each other in the radial direction. A line connecting the slits 46*a* and 46*b* is substantially perpendicular to the line connecting the first and the second cap portions 22 and 23.

During transportation of the compressor 10, the port cover 40 is attached to the compressor 10. Specifically, the closed-top cylinder member 24 is put over the stud bolt 14. The first and the second cap portions 22 and 23 are press-fitted into the suction port 12 and the discharge port 13, respectively. As a consequence, the suction port 12, the discharge port 13, and the stud bolt 14 are protected by the port cover 40.

When the compressor 10 is mounted to the vehicle air conditioner, the port cover 40 is removed from the compressor 10. As depicted by the white arrow 27, the handle 25 is pulled in the longitudinal direction of the closed-top cylinder member 24. As a consequence, the second cap portion 23 is pulled out from the discharge port 13. When the second cap portion 23 is pulled out from the discharge port 13, the slits 46*a* and 46*b* of the closed-top cylinder member 24 are opened so that the open end of the closed-top cylinder member 24, i.e., the one end faced to the compressor housing 11 is substantially increased in diameter. When the handle 25 is further pulled upward, the closed-top cylinder member 24 is opened in a hinge-like fashion relative to the top wall, i.e., the end plate portion 24*b*. Then, the closed-top cylinder member 24 is separated from the stud bolt 14 without interference with the stud bolt 14. When the handle 25 is further pulled upward, the first cap portion 22 is pulled out from the suction port 12.

The above-mentioned port cover 40 can readily be removed from the compressor 10 without causing interference between the closed-top cylinder member 24 and the stud bolt 14. Furthermore, the second cap portion 23 is at first pulled out from the discharge port 13 and, thereafter, the first cap portion 22 is pulled out from the suction port 12. Accordingly, only a small force is required to remove the port cover 40. In addition, removal of the port cover 40 can be performed by a single operation of pulling the handle 25 in the direction depicted by the white arrow 27.

The handle 25 may extend from the first cap portion 22, not from the second cap portion 23. Alternatively, the handle 25 may be provided at each of the first and the second cap portions 22 and 23. The slit 24*a* or the slit 24*b* may be omitted. In this case, the port cover 40 can be removed by pulling the handle 25 in a direction similar to that described in conjunction with the port cover 30 illustrated in FIGS. 3A and 3B.

Figure 5:
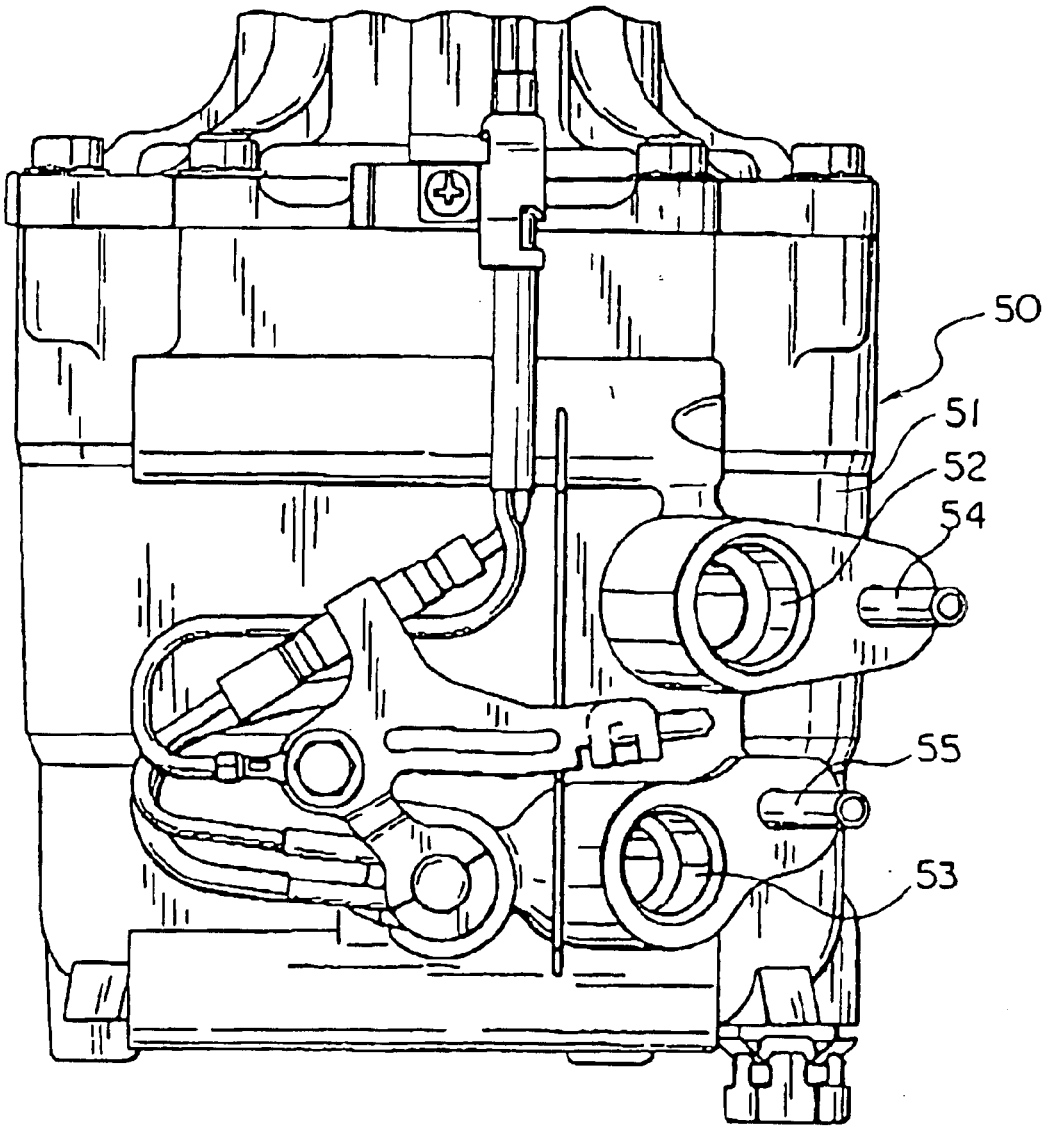
FIG. 5 is a perspective view of a compressor as another example.

Referring to FIG. 5, a compressor as another example will be described.

The compressor depicted at 50 in FIG. 5 is for use in an air conditioner for a vehicle and comprises a compressor housing 51. The compressor housing 51 is provided with a suction port 52 and a discharge port 53 to be connected with pipes (not shown).

In the vicinity of the suction port 52, a first stud bolt 54 is planted on the compressor housing 51 and protrudes therefrom. In the vicinity of the discharge port 53, a second stud bolt 55 is planted on the compressor housing 51 and protrude therefrom. The first and the second stud bolts 54 and 55 serve to fix and secure the pipes connected to the suction port 52 and the discharge port 53 to the compressor housing 51. Each of the first and the second stud bolts 54 and 55 has a thread formed on its outer peripheral surface. A combination of the first and the second stud bolts54 and 55 forms a pipe fixing portion.

Figure 6A:
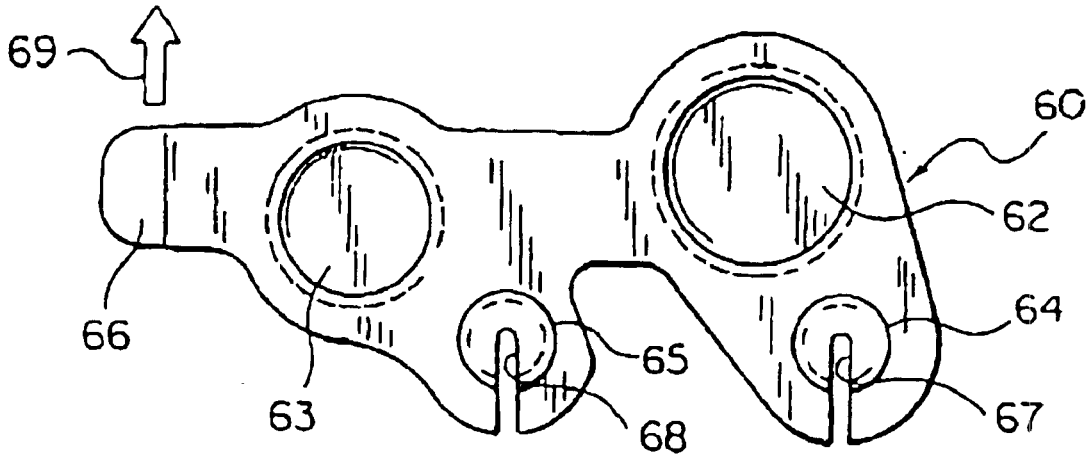
FIG. 6A is a plan view of a port cover according to a fourth embodiment of the present invention.
Figure 6B:
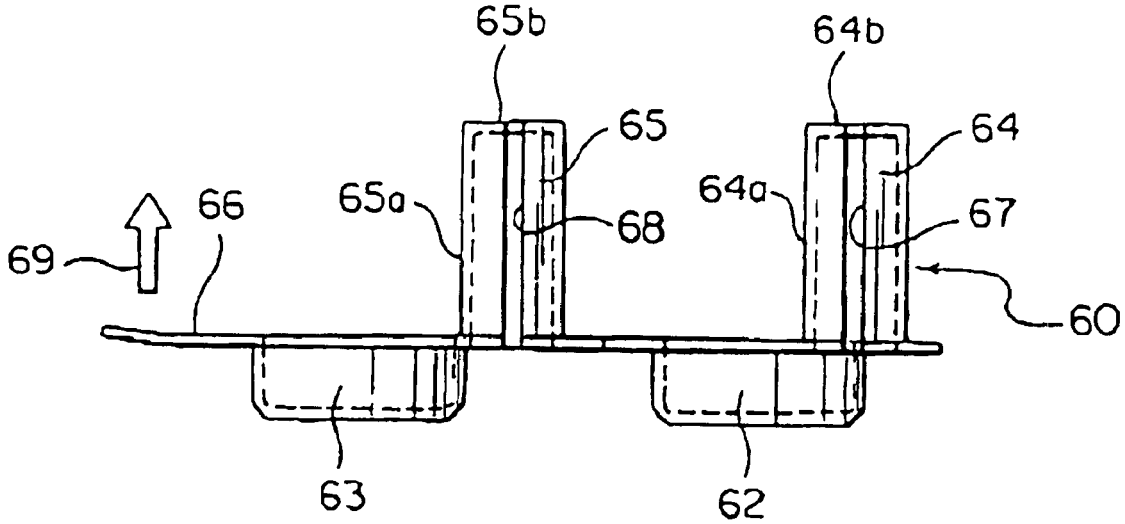
FIG. 6B is a front view of the port cover illustrated in FIG. 6A.

Referring to FIGS. 6A and 6B in addition to FIG. 5, description will be made of a port cover according to a fourth embodiment of the present invention.

The port cover depicted at 60 in FIGS. 6A and 6B serves to protect not only the suction port 52 and the discharge port 53 but also the first and the second stud bolts 54 and 55. The port cover 60 is made of elastomer and integrally formed. The port cover 60 has a first cap portion 62 having a closed-bottom cylindrical shape and adapted to be press-fitted into the suction port 52, a second cap portion 63 having a closed-bottom cylindrical shape and adapted to be press-fitted to the discharge port 53, a first closed-top cylinder member 64 to cover the first stud bolt 54, a second closed-top cylinder member 65 to cover the second stud bolt 55, and a handle 66 extending from the second cap portion 63.

The first closed-top cylinder member 64 has a long cylindrical portion 64*a* faced to a side surface of the first stud bolt 54, and an end plate portion 64*b* integrally coupled to an upper end of the cylindrical portion 64*a* and faced to an end of the first stud bolt 54. The cylindrical portion 64*a* as a side wall of the first closed-top cylinder member 64 is provided with a single recess 67 extending from an open end towards a top wall (i.e., the end plate portion 64*b*) of the first closed-top cylinder member 64 in its longitudinal direction. The recess 67 has an open end oriented in a direction substantially perpendicular to a line connecting the first and the second cap portions 62 and 63.

The second closed-top cylinder member 65 has a long cylindrical portion 65*a* faced to a side surface of the second stud bolt 55, and an end plate portion 65*b* integrally coupled to an upper end of the cylindrical portion 65*a* and faced to an end of the second stud bolt 55. The cylindrical portion 65*a* as a side wall of the second closed-top cylinder member 65 is provided with a single recess 68 extending from an open end towards a top wall (i.e., the end plate portion 65*b*) of the second closed-top cylinder member 65 in its longitudinal direction. The recess 68 has an open end oriented in a direction substantially perpendicular to a line connecting the first and the second cap portions 62 and 63.

During transportation of the compressor 50, the port cover 60 is attached to the compressor 50. Specifically, the first and the second closed-top cylinder members 64 and 65 are put over the first and the second stud bolts 54 and 55, respectively. The first and the second cap portions 62 and 63 are press-fitted into the suction port 52 and the discharge port 53, respectively. As a consequence, the suction port 52, the discharge port 53, the first stud bolt 54, and the second stud bolt 55 are protected by the port cover 60.

When the compressor 50 is mounted to the vehicle air conditioner, the port cover 60 is removed from the compressor 50. As depicted by a white arrow 69, the handle 66 is pulled in a direction in which the second closed-top cylinder member 65 extends and in which the recess 68 is increased in width. As a consequence, the second cap portion 63 is pulled out from the discharge port 53. Simultaneously when the second cap portion 63 is pulled out from the discharge port 53, the recess 68 is increased in width so that a portion of the side wall of the second closed-top cylinder member 65 which is near a side line of the recess 68 is turned outside. Therefore, the second closed-top cylinder member 65 is separated from the second stud bolt 55 without interfering with the second stud bolt 55.

The handle 66 is further pulled in the direction depicted by the white arrow 69 to pull out the first cap portion 62 from the suction port 52. Simultaneously when the first cap portion 62 is pulled out from the suction port 52, the recess 67 is increased in width so that a portion of the side wall of the first closed-top cylinder member 64 which is near a side line of the recess 67 is turned outside. Therefore, the first closed-top cylinder member 64 is separated from the first stud bolt 54 without interfering with the first stud bolt 54.

The above-mentioned port cover 60 can readily be removed from the compressor 50 without causing interference between the first and the second closed-top cylinder member 64 and 65 and the first and the second stud bolts 54 and 55. Furthermore, the second cap portion 63 is at first pulled out from the discharge port 53 and, thereafter, the first cap portion 62 is pulled out from the suction port 52.

Accordingly, only a small force is required to remove the port cover 60. In addition, removal of the port cover 60 can be performed by a single operation of pulling the handle 66 in the direction depicted by the white arrow 69.

The handle 66 may extend from the first cap portion 62, not from the second cap portion 63. The port cover 60 may be divided into a first part including the first cap portion 62 and the first closed-top cylinder member 64 and a second part including the second cap portion 63 and the second closed-top cylinder member 65 and separated from the first part.

What is claimed is:

1. A port cover which is removably attached to a compressor comprising a compressor housing, a port formed on said compressor housing to be connected to a pipe, and a pipe fixing portion formed on said compressor housing in the vicinity of said port to protrude therefrom and adapted to fix said pipe and which serves to protect said port when said port cover is attached to said compressor, wherein said port cover is made of elastomer and integrally formed, said port cover comprising:

a cap member adapted to close said port;

a cover member coupled to said cap member and adapted to cover said pipe fixing portion, said cover member having a cylindrical portion faced to a side surface of said pipe fixing portion; and a handle extending from said cap member, said cylindrical portion having at least one specific portion extending from a first end of said cylindrical portion opposite to said compressor housing towards a second end opposite to said first end, said at least one specific portion allowing said first end of said cylindrical portion to be increased in diameter.

2. The port cover according to claim 1, wherein said cover member is coupled to said second end of said cylindrical portion and has an end plate portion faced to an end of said pipe fixing portion.

3. The port cover according to claim 1, wherein said pipe fixing portion has a stud bolt planted on said compressor housing, said cover member covering said stud bolt.

4. The port cover according to claim 1, wherein said port has a suction port for introducing a fluid and a discharge port for delivering said fluid, said cap member comprising:

a first cap portion coupled to said cover member and adapted to close said suction port; and a second cap portion coupled to said cover member and adapted to close said discharge port.

5. The port cover according to claim 4, wherein said first cap portion is adapted to be press-fitted into said suction port and said second cap portion is adapted to be press-fitted into said discharge port.

6. The port cover according to claim 4, wherein said cover member is located between said first and said second cap portions.

7. The port cover according to claim 6, wherein said handle extends from at least one of said first and said second cap portions in a direction away from said cover member.

8. The port cover according to claim 7, wherein said cylindrical portion has first and second parts coupled to said first and said second cap portions, respectively, said at least one specific portion being formed in an area located between said first and said second parts in a circumferential direction of said cylindrical portion.

9. The port cover according to claim 1, wherein said port comprises a suction port for introducing a fluid and a discharge port for delivering said fluid, said pipe fixing portion comprising a first stud bolt planted on said compressor housing in the vicinity of said suction port and a second stud bolt planted on said compressor housing in the vicinity of said discharge port, said cover member having a first cap portion adapted to close said suction port and a second cap portion adapted to close said discharge port, said handle extending from at least one of said first and said second cap portions, said cover member having a first cover portion for covering said first stud bolt and a second cover portion for covering said second stud bolt, said first and said second cover portions having cylindrical portions faced to side surfaces of said first and said second stud bolts, respectively, said at least one specific portion being formed in each of said cylindrical portions.

10. The port cover according to claim 1, wherein said at least one specific portion has an interrupting part for making at least said first end of said cylindrical portion discontinuous in a circumferential direction.

11. The port cover according to claim 10, wherein said interrupting part is a recess.

12. The port cover according to claim 10, wherein said interrupting part is a slit.

* * * * *